US006283901B1

(12) United States Patent
Chang

(10) Patent No.: US 6,283,901 B1
(45) Date of Patent: Sep. 4, 2001

(54) DEVICE FOR EFFECTING RESISTANCE

(76) Inventor: Huang Tung Chang, P.O. Box 487, Chang-Hua City 500 (TW)

( * ) Notice: Subject to any disclaimer, the term of this patent is extended or adjusted under 35 U.S.C. 154(b) by 0 days.

(21) Appl. No.: 09/695,922

(22) Filed: Oct. 26, 2000

Related U.S. Application Data

(63) Continuation-in-part of application No. 09/502,052, filed on Feb. 11, 2000, now abandoned.

(51) Int. Cl.[7] ..... A63B 22/06; A63B 69/16

(52) U.S. Cl. ..... 482/903; 482/63; 310/77; 310/93; 310/105; 310/106; 310/263; 188/161; 188/163; 188/164; 188/267

(58) Field of Search ..... 310/77, 92, 93, 310/103–110; 188/267, 161–165; 482/5, 63, 903

(56) References Cited

U.S. PATENT DOCUMENTS 4,713,567 * 12/1987 Fey et al. ..... 310/105

* cited by examiner

*Primary Examiner*—Ramon M. Barrera

(57) ABSTRACT

A device for effecting resistance is incorporated into an exercise or rehabilitation machine and is formed of an excited magnetic cylinder, an excited magnetic coil, a rotary cylinder, and two support frames. As the excited magnetic coil is connected to the alternating current power source in conjunction with a control switch, the exercise or rehabilitation machine is provided with a magnetic resistance of a predetermined magnitude. The excited magnetic cylinder is provided in one side with an annular wavy magnetic interstice for guiding the magnetic line toward the rotary cylinder, thereby resulting in a magnetic resistance causing the fixed excited magnetic cylinder and the rotary cylinder to attract each other. The rotary cylinder is connected to a link device of the exercise or rehabilitation machine, so as to provide the exercise or rehabilitation machine with a resistance.

1 Claim, 6 Drawing Sheets

DEVICE FOR EFFECTING RESISTANCE

This application is a CIP of the U.S. Pat. Ser. No. 09/502,052, filed on Feb. 11, 2000, and now abandoned.

FIELD OF THE INVENTION

The present invention relates generally to an exercise or rehabilitation machine, and more particularly to a device for providing the exercise or rehabilitation machine with resistance.

BACKGROUND OF THE INVENTION

The conventional exercise or rehabilitation machine is generally provided with a resistance device, which brings about resistance by means of friction or oil pressure. The friction-type resistance device is susceptible to wear and load unstableness, which unable the device to control the magnitude of resistance with precision. The oil pressure resistance device is vulnerable to oil leak and is rather noisy while in operation.

SUMMARY OF THE INVENTION

The primary objective of the present invention is to provide a device for effecting resistance. The device of the present invention is free of the deficiencies of the conventional devices described above.

In keeping with the principle of the present invention, the foregoing objective of the present invention is attained by a resistance device which is designed for use in an exercise or rehabilitation machine. The device of the present invention comprises an excited magnetic cylinder, an excited magnetic coil, a rotary cylinder, and two support frames. The excited magnetic coil is disposed in the excited magnetic cylinder which is provided with a fixed shaft. The rotary cylinder is rotatably mounted on the fixed shaft. The excited magnetic cylinder is provided in the periphery of the midsegment thereof with an annular wavy interstice. The ridges of the wavy interstice are provided with a projection which is used as a magnetic pole induction area. The rotary cylinder is provided with a slot which is fitted over the magnetic pole induction area. The eddy current induced by the rotary cylinder interacts with the magnetic flux to bring about a rotation moment capable of an effective control of an arresting wheel with precision.

The foregoing objective, features, and advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
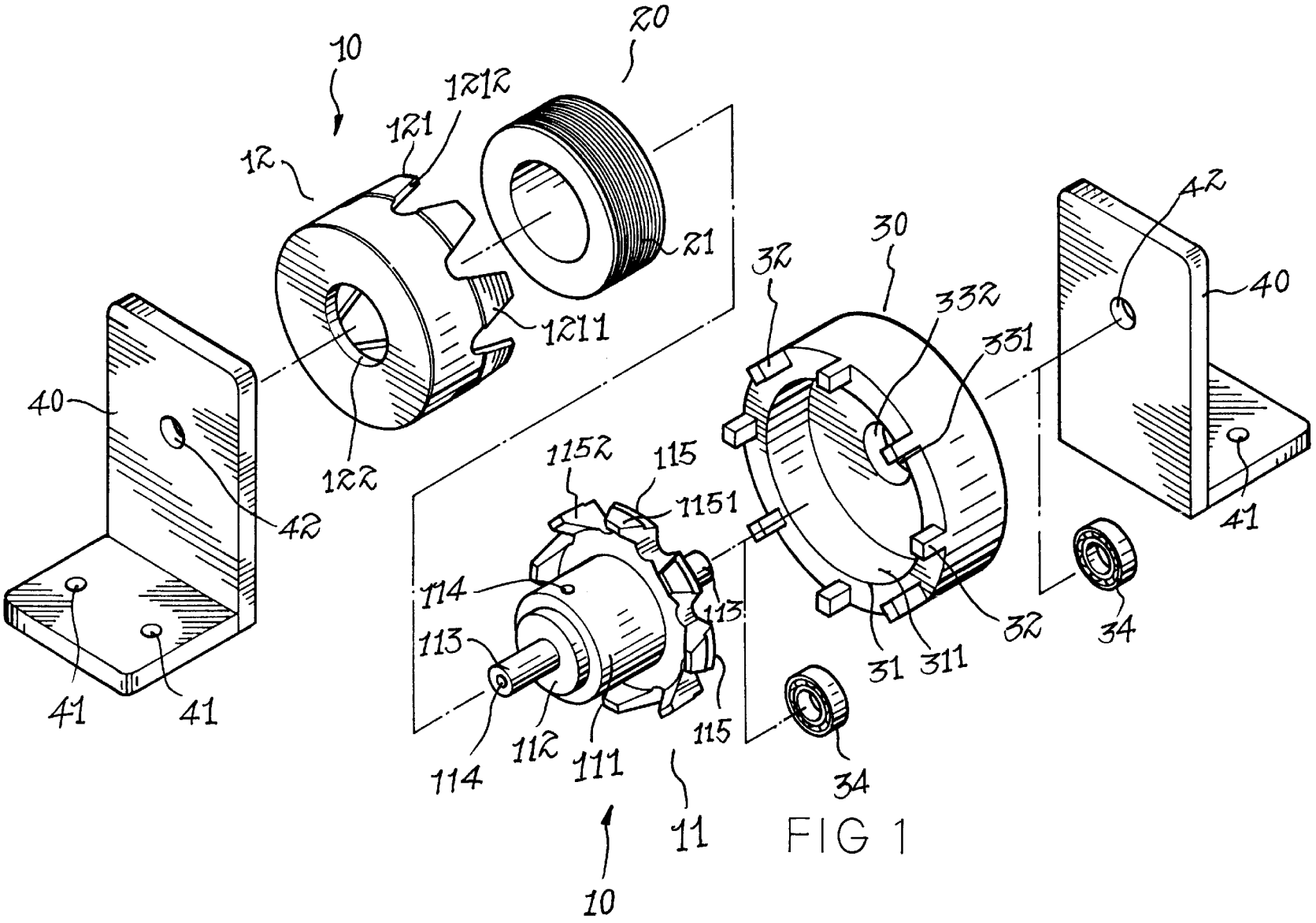
FIG. 1 shows an exploded view of the preferred embodiment of the present invention.
Figure 2:
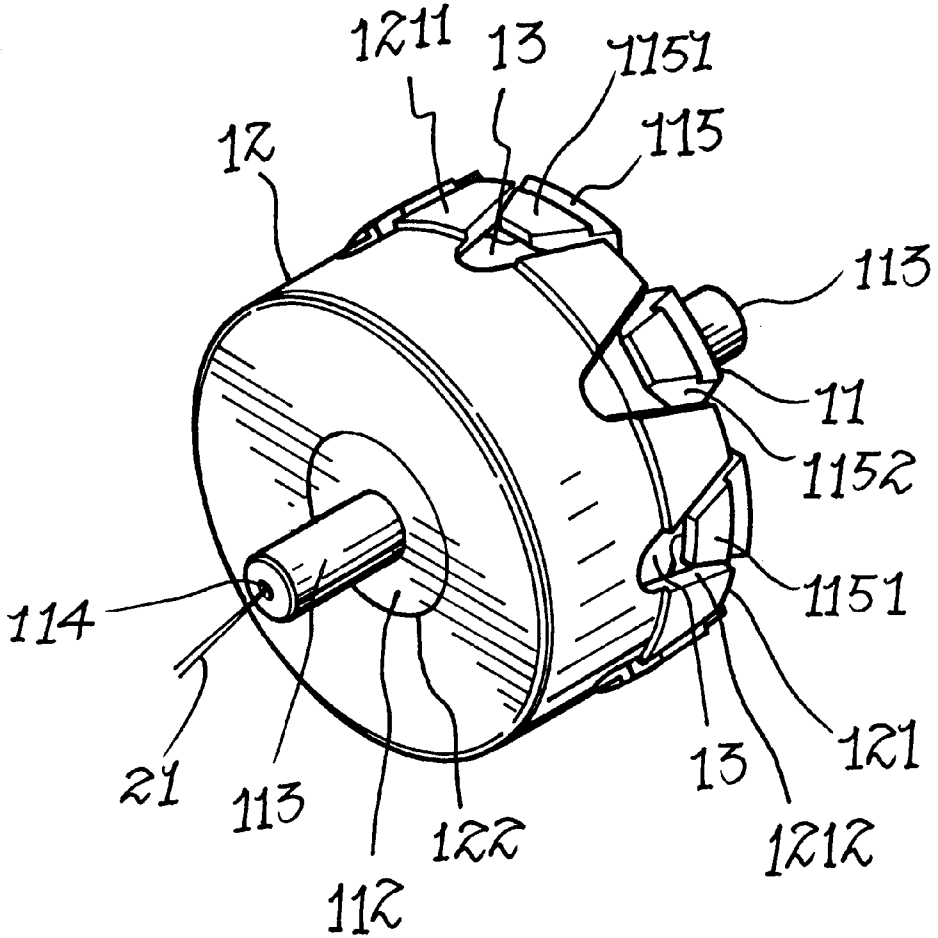
FIG. 2 shows a perspective view of the excited magnetic cylinder of the preferred embodiment of the present invention.

As shown in FIGS. 1–5, a device embodied in the present invention comprises an excited magnetic cylinder 10, an excited magnetic coil 20, a rotary cylinder 30, and two support frames 40. The component parts of the device of the present invention are made of a magnetically permeable material.

The excited magnetic cylinder 10 comprises a toothed disk 11 and a round toothed cylinder 12. The toothed disk 11 is provided in the axial direction with a fixed shaft 113. Located between one side and the fixed shaft 113 are a shaft seat 111 and a protruded ring 112 for locating the toothed cylinder 12. The toothed disk 11 is provided in the fringe with a plurality of teeth 115, with each having a projected step 1151 and an inclined plane 1152 serving as a current guiding surface. Located between the shaft seat 111 and the fixed shaft 113 is an L-shaped through hole 114 through which a wire 21 of the excited magnetic coil 20 is put. The toothed cylinder 12 is provided at one end with a plurality of ridges 121, with each having a projection 1211 and a slanted surface 1212 serving as a magnetic field current guiding surface. The other end of the toothed cylinder 12 is closed and is provided in the center with an axial hole 122 for fitting over the protruded ring 112 of the toothed disk 11.

The excited magnetic coil 20 is fixed on the shaft seat 111 such that the wire 21 of the excited magnetic coil 20 is put out of the fixed shaft 113 via the through hole 114 to connect to a control switch C for effecting a stepless voltage adjustment control.

The rotary cylinder 30 is provided with a round slot 31 which is in turn provided with a plurality of ribs 32 arranged equidistantly, and a link shaft 33 which is provided with an axial through hole 331 in communication with the round slot 31. The through hole 331 is provided at both ends with a circular slot 332 for disposing a bearing 34.

The support frames 40 are of an L-shaped construction and are provided at the bottom with a round hole 41 for fastening the support frames 40 with an exercise or rehabilitation machine. The support frames 40 are further provided with a locating hole 42 for locating the fixed shaft 113 of the toothed disk 11.

Figure 3:
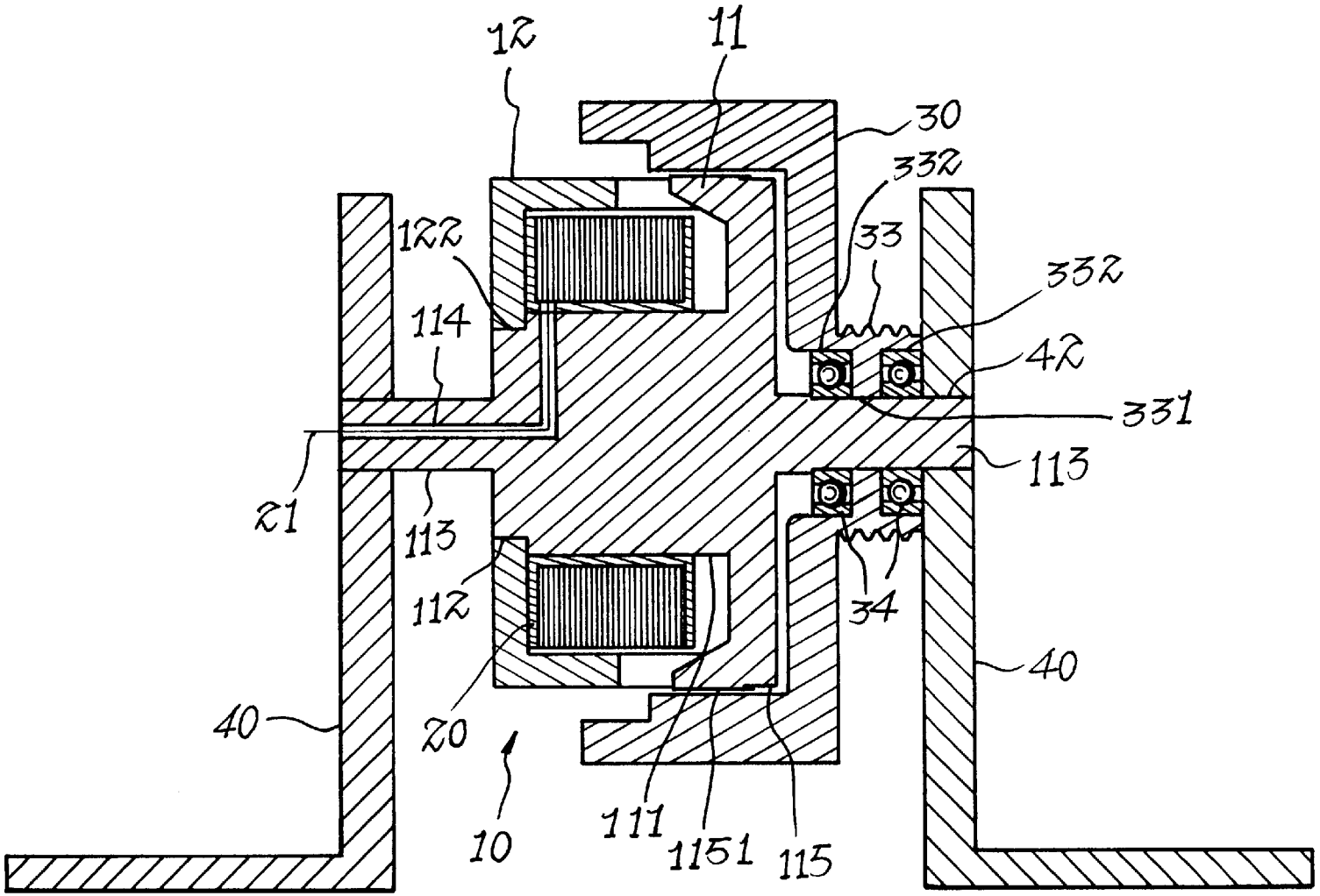
FIG. 3 shows a sectional view of the preferred embodiment of the present invention in combination.
Figure 4:
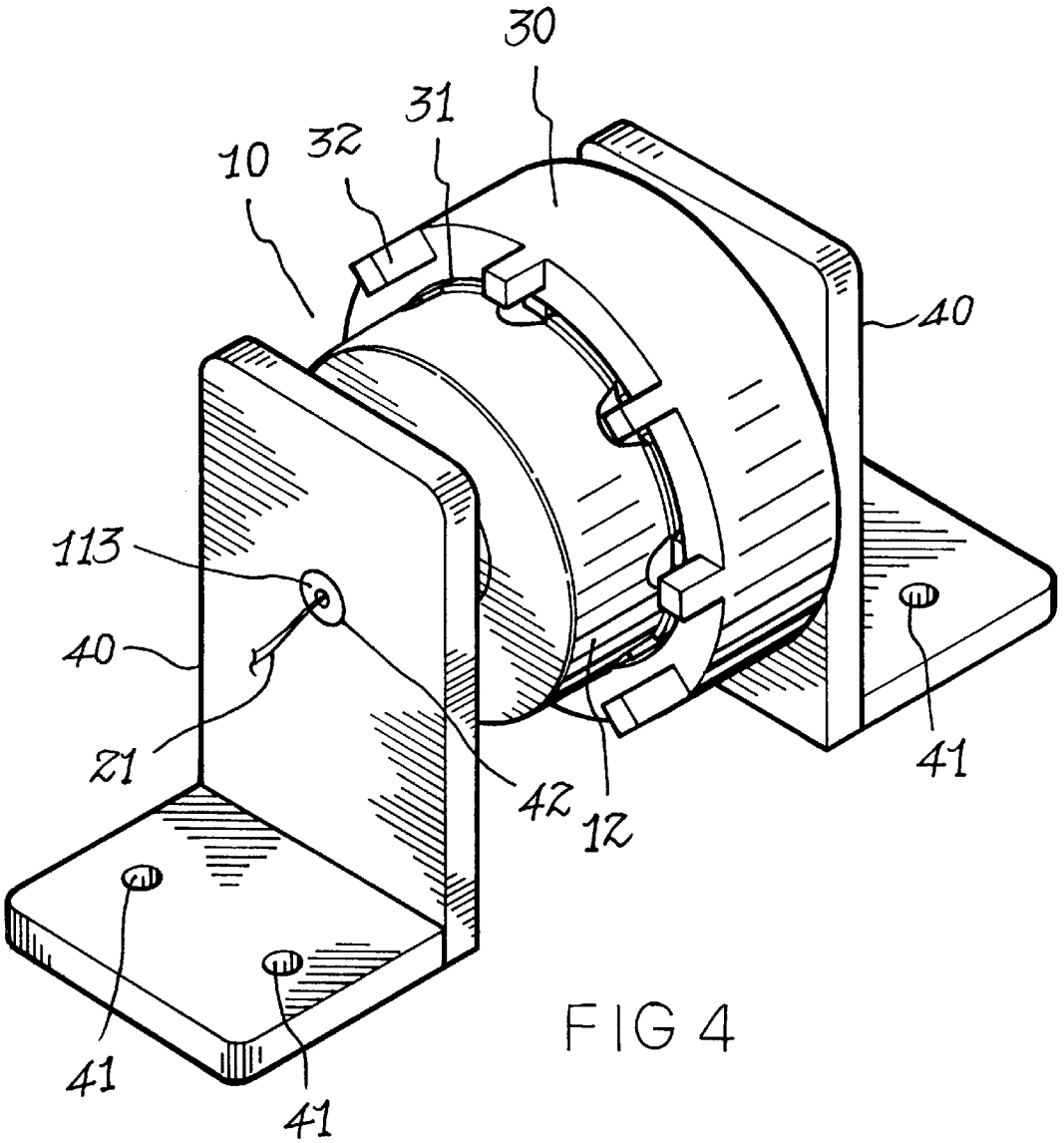
FIG. 4 shows a perspective view of the preferred embodiment of the present invention in combination.
Figure 5:
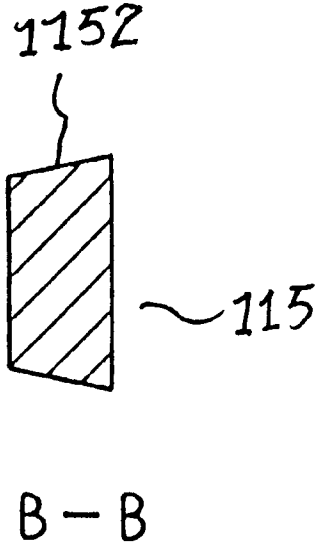
FIG. 5 shows a sectional view of the tooth of the excited magnetic cylinder of the preferred embodiment of the present invention.
Figure 5:
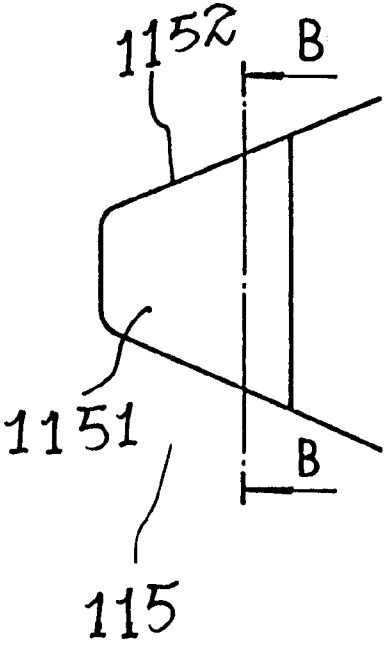
Figure 6:
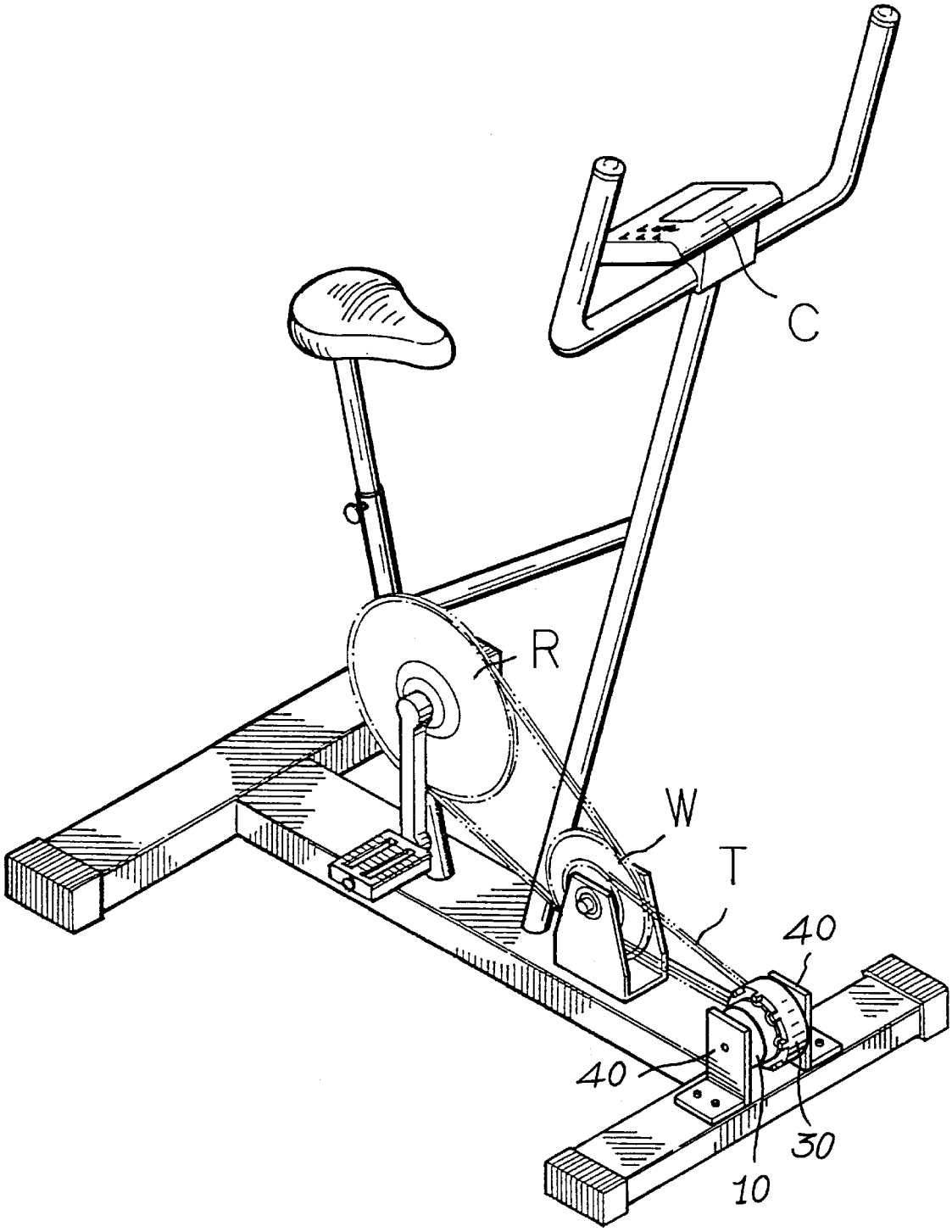
FIG. 6 shows a schematic view of an exercise machine comprising the device of the present invention.

In combination, the excited magnetic coil 20 is mounted on the shaft seat 111 of the toothed disk 11 of the excited magnetic cylinder 10 such that the wire 21 of the magnetic coil 20 is connected to the control switch C and the power source via the through hole 114 and the fixed shaft 113, as shown in FIGS. 3 and 6. The axial hole 122 of the toothed cylinder 12 of the excited magnetic cylinder 10 is fitted over the protruded ring 112 of the shaft seat 11 such that the fringe of the excited magnetic cylinder 10 is provided with a wavy interstice 13 toward which the magnetic lines are guided. The circular slot 332 is provided with the bearing 34 for mounting the rotary cylinder 30 on the fixed shaft 113 which is located in the locating hole 42 of the support frames 40.

The alternating current is made available to the excited magnetic coil 20 via a rectifier, thereby resulting in formation of a closed loop magnetic field, with two sides of the wavy interstice 13 serving as N/S poles for bringing about a magnetic field and a magnetic flux, and with the inclined plane 1152 and the slanted surface 1212 serving as the magnetic field current guiding surfaces. The fringes of the toothed disk 11 and the toothed cylinder 12 serve as the magnetic path, whereas the projected step 1151 and the projection 1211 serve as the magnetic path induction area. In light of the gap between the slot wall 311 of the slot 31 of the rotary cylinder 30 and the wavy interstice 13 of the excited magnetic cylinder 10, a magnetic resistance is brought about between the rotary cylinder 30 and the excited magnetic cylinder 10.

As the rotary cylinder 30 is actuated by an external force to turn, the slot wall 311 of the slot 31 is moved continually past the induction areas of the projected step 1151 and the projection 1211, thereby resulting in the eddy current which interacts with the magnetic flux to bring about an action force acting on the rotary cylinder 30. It must be noted here that the gaps between the induction areas of the projected step 1151 and the projection 1211 are not uniform in density in view of the fact that the fringe of the slot 31 of the rotary cylinder 30 is provided with a plurality of ribs 32.

As shown in FIG. 6, the device of the present invention is incorporated into an exercise machine such that the link shaft 33 of the rotary cylinder 30 of the device of the present invention is linked with a belted wheel "W" of the exercise machine by a transmission belt "T". The belted wheel "W" is in turn linked with an exercise wheel "R" of the exercise machine. As soon as the device of the present invention is connected to the power source, a predetermined voltage input is made available to the excited magnetic coil 20 via the control switch C which is capable of a stepless voltage adjustment control. The magnitude of resistance is dependent on the magnitude of the voltage input that is made available to the excited magnetic coil 20. The induction areas of the projected step 1151 and the projection 1211 serve as magnetic poles. When the exercise wheel "R" is pedaled, the rotary cylinder 30 is actuated to turn to result in the interaction of the magnetic flux and the eddy current between the induction areas of the projected step 1151 and the projection 1211. The resistance can be then transmitted to the exercise wheel "R" of the exercise machine via a transmission belt linking the link shaft 33 of the rotary cylinder 30 with the belted wheel "W" (or sprocket wheel) of the exercise machine.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A device for effecting resistance, said device being incorporated into an exercise or rehabilitation machine such that a magnetic resistance of a closed loop magnetic field effect is brought about at such time when the exercise or rehabilitation machine is in operation, said device comprising an excited magnetic cylinder, an excited magnetic coil, a rotary cylinder, and two support frames, said excited magnetic coil being disposed in said excited magnetic cylinder which is provided in the fringe thereof with an annular wavy interstice having two sides acting as N/S poles for bringing about magnetic field, said two sides provided with a plurality of ridges, with each having a projection serving as a magnetic pole induction area, said rotary cylinder provided with a round slot having an annular wall contiguous to said wavy interstice, said excited magnetic cylinder being provided in two sides with a fixed shaft being located in a locating hole of said support frames, said excited magnetic cylinder bringing about a closed loop magnetic field at the time when said excited magnetic coil is connected to a power source, thereby causing a magnetic line to be guided via said projections of said ridges, so as to bring about a magnetic resistance action causing said excited magnetic cylinder and said rotary cylinder to attract each other; wherein said rotary cylinder is provided at one end thereof with said round slot for fitting over said annular wavy interstice of said excited magnetic cylinder such that an appropriate gap is formed, said round slot being provided in the fringe with a plurality of ribs arranged equidistantly, said rotary cylinder being provided at other end thereof with a link shaft for linking said device with the exercise machine, said link shaft provided along the axial direction thereof with a through hole in communication with said round slot, said through hole provided at two ends thereof with a slot for disposing a bearing to facilitate said through hole to be fitted over said fixed shaft of said excited magnetic cylinder such that said rotary cylinder turns freely on said fixed shaft of said excited magnetic cylinder; wherein said excited magnetic cylinder is formed of a toothed disk and a toothed cylinder, said toothed disk being provided in the axial direction thereof with a fixed shaft, a shaft seat and a protruded ring which are located between said toothed disk and said fixed shaft, said toothed disk being provided in the fringe with a plurality of teeth whereby said teeth are provided with a projected step and are further provided in the side of tooth edge thereof with an inclined plane serving as a current guiding surface, said shaft seat and said fixed shaft being provided with an L-shaped through hole located therebetween for receiving a wire of said excited magnetic coil such that said wire is connected to a power source, said toothed cylinder being provided at one end with a plurality of ridges whereby said ridges are provided with a projection and are further provided in the side of tooth edge thereof with a slanted surface, said toothed cylinder being provided at other end with an axial hole which is fitted over said protruded ring of said toothed disk, said toothed disk and said toothed cylinder enabling the peripheral edge of said excited magnetic cylinder to have said annular wavy interstice.

* * * * *